US007455763B2

(12) United States Patent
Luo et al.

(10) Patent No.: US 7,455,763 B2
(45) Date of Patent: Nov. 25, 2008

(54) RECYCLING PROCESS FOR DEMETALIZATION OF HYDROCARBON OIL

(75) Inventors: Lailong Luo, Xinjiang (CN); Chunge Niu, Xinjiang (CN); Shuyan Yu, Xinjiang (CN); Zhongting Ma, Xinjiang (CN); Xiangsheng Meng, Xinjiang (CN); Bo Ouyang, Xinjiang (CN); Yun Han, Xinjiang (CN)

(73) Assignee: Karamay Jinshan Petrochemical Limited Company, Xinjiang (CN)

( * ) Notice: Subject to any disclaimer, the term of this patent is extended or adjusted under 35 U.S.C. 154(b) by 363 days.

(21) Appl. No.: 10/558,920

(22) PCT Filed: Jun. 2, 2004

(86) PCT No.: PCT/CN2004/000590

§ 371 (c)(1),
(2), (4) Date: Nov. 30, 2005

(87) PCT Pub. No.: WO2005/005579

PCT Pub. Date: Jan. 20, 2005

(65) Prior Publication Data

US 2007/0062849 A1 Mar. 22, 2007
US 2008/0237091 A9 Oct. 2, 2008

(30) Foreign Application Priority Data

Jun. 3, 2003 (CN) ..... 03 1 37118

(51) Int. Cl.
*C10G 17/00* (2006.01)
*C10G 45/00* (2006.01)

(52) U.S. Cl. ..... 208/251 R; 208/188; 208/252; 208/309; 208/708; 210/708; 210/737; 423/155; 423/165; 516/171; 585/866

(58) Field of Classification Search ..... 208/188, 208/251 R, 252, 309, 708; 516/171; 210/708, 210/737; 423/155, 165; 585/866
See application file for complete search history.

(56) References Cited

U.S. PATENT DOCUMENTS 2,900,350 A * 8/1959 Kirkpatrick ..... 516/171

(Continued)

FOREIGN PATENT DOCUMENTS

CN 1054261 A 4/1991
JP 07-268359 10/1995

*Primary Examiner*—Glenn Caldarola
*Assistant Examiner*—Prem C. Singh
(74) *Attorney, Agent, or Firm*—Kilyk & Bowersox, P.L.L.C.

(57) ABSTRACT

A recycling process for the demetalization of hydrocarbon oil comprises recycling the following steps:

a demetalizing composition for hydrocarbon oil or an aqueous solution thereof is sufficiently mixed with hydrocarbon oil in a desired proportion, and the resultant mixture is subjected to a conventional electrically desalting process to obtain a demetalized hydrocarbon oil and an aqueous desalted solution containing the desalted metal salts;

the aqueous desalted solution containing the metal salts is then sufficiently mixed with a precipitating agent in a desired proportion and is subjected to a displacement reaction, and an aqueous solution containing the demetalizing composition is recovered by separating out the residue of the metal salts produced in the displacement reaction, which is poorly soluble or insoluble in water, with a solid-liquid separator; and the recovered aqueous solution containing the demetalizing composition for hydrocarbon oil, which meets the requirements for metal ions in demetalized hydrocarbon oil, is then mixed with hydrocarbon oil in a desired proportion for a next cycle.

The present invention has the following advantages such as high efficiency of demetalization, reduction of pollution to the environment and the production cost as well as the metal salt product obtained by treating and collecting the desalted residue of the metal salt.

19 Claims, 1 Drawing Sheet

U.S. PATENT DOCUMENTS 4,853,109 A * 8/1989 Reynolds ..... 208/252
6,086,750 A 7/2000 Eaton
6,120,678 A * 9/2000 Stephenson et al. ..... 208/188
6,383,368 B1 5/2002 Eaton

* cited by examiner

RECYCLING PROCESS FOR DEMETALIZATION OF HYDROCARBON OIL

This application is a National Stage Application of PCT/CN2004/000590, filed Jun. 2, 2004.

FIELD OF THE INVENTION

The present invention relates to a recycling process for the demetalization of hydrocarbon oil, in which metal ions are removed from the hydrocarbon oil.

BACKGROUND OF THE INVENTION

The conventional process for demetalizing hydrocarbon oil generally utilizes an electrically desalting process in which a demetalizing agent, a demulsifier and water are mixed with hydrocarbon oil in a desired proportion, and the obtained mixture is then fed into a primary desalting tank and separated sufficiently into a primary desalted water and primary purified oil; the desalted primary water is discharged, and the purified primary oil from the primary desalting tank is mixed with the mixed solution of the demetalizing agent, the demulsifier and water proportionally; the resultant mixture is then fed into the secondary desalting tank to separate into oil and water under a predetermined electrical field, the isolated oil being the purified secondary oil and the secondary desalted water being either discharged or fed back to the primary desalting tank. Although the prior processes have the advantages of effective demetalization of hydrocarbon oil and easiness of operation, there are disadvantages such as insufficient utilization of the discharged water, severe pollution to the environment, waste of the demetalizing agent, demulsifier and water, and thereby high production cost of hydrocarbon oil per ton.

SUMMARY OF THE INVENTION

The present invention provides a recycling method for demetalization of hydrocarbon oil, which has less pollution to the environment and higher efficiency of demetalization.

The present invention is achieved according to a recycling process for the demetalization of hydrocarbon oil, comprising recycling the following steps:

a demetalizing composition for hydrocarbon oil or an aqueous solution thereof is sufficiently mixed with hydrocarbon oil in a desired proportion, and the resultant mixture is subjected to a conventional electrically desalting process to obtain a demetalized hydrocarbon oil and an aqueous desalted solution containing the desalted metal salts;

the aqueous desalted solution containing the metal salts is then sufficiently mixed with a precipitating agent in a desired proportion and is subjected to a displacement reaction, and an aqueous solution containing the demetalizing composition is recovered by separating out the residue of the metal salts produced in the displacement reaction, which is poorly soluble or insoluble in water, with a solid-liquid separator; and the recovered aqueous solution containing the demetalizing composition for hydrocarbon oil, which meets the requirements for metal ions in demetalized hydrocarbon oil, is then mixed with hydrocarbon oil in a desired proportion for a next cycle.

The demetalizing composition for hydrocarbon oil comprises 10-99.5% by weight of a demetalizing agent, 0-90% by weight of a demulsifier, with the balance of a demetalizing aid; and the mixing proportion of the demetalizing composition for hydrocarbon oil to the hydrocarbon oil is 0.002%-5% by weight based on the hydrocarbon oil.

The aqueous solution of demetalizing composition for hydrocarbon oil comprises 0.3-99.5% by weight of a demetalizing agent, 0-80% by weight of a demulsifier, 0-80% by weight of a demetalizing aid with the balance of water; and the mixing proportion of the aqueous solution of the demetalizing composition to the hydrocarbon oil is 0.002-99.5% by weight based on the hydrocarbon oil.

The demetalizing agent is any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components, and the demetalizing agents can be interchangeable with each other; and/or, the demulsifier is any one selected from the group consisting of KR-40, LH-1-12, LH-14, PC-6, GAR-36, SH-1, SH-4, AY-910 and other commercially available demulsifier suitable for demulsification of the hydrocarbon oil and other demulsifier known to the public suitable for demulsification of the hydrocarbon oil and the demulsifiers can be interchangeable with each other; and/or, the demetalizing aids is any one selected from the group consisting of SP-80, SP-60, alkyl phenol polyoxyethylene ether, styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components and the demetalizing aids can be interchangeable with each other.

The aqueous desalted solution containing the metal salts is sufficiently mixed with the precipitating agent with a mixing proportion of from 1:1 to 10:1 by mole with respect to the metal salt contained in the aqueous desalted solution and the precipitating agent, at a temperature ranging from ambient temperature to 150° C.

The precipitating agent is selected from the group consisting of inorganic acids or organic acids which can react with the desired metal ions to be demetalized and produce precipitates poorly soluble or insoluble in water; or selected from the group consisting of sulfuric acid, phosphoric acid, hydrofluoric acid, sulfonic acid, oxalic acid and citric acid.

The residue of the separated metal salts is collected under the following conditions: firstly, the aqueous solution containing the metal salt residue is filtered at a temperature of from ambient temperature to 150° C. and at a pressure of from −1 MPa to 1 MPa to obtain the residue of the metal salts; then the metal salt residue is washed with water until the washed water has a pH value of 5-7 at a temperature of from ambient temperature to 100° C.; thereafter, the washed metal salt residue is filtered and separated by gravitational settling or centrifugal settling, or filtered at a temperature of from ambient temperature to 100° C. and at a pressure of from −1 MPa to 1 MPa and dried at a temperature of 80° C. to 200° C. until the water content being less than 1% by weight, thereby obtaining the metal salts.

When the concentration of the above-mentioned demetalizing agents is higher than the prescribed proportion of the demetalizing agent to the hydrocarbon oil, 1%~500% of water, 0.001%~0.02% of the demulsifier, and 0.001%~0.02% of demetalizing aids, each based on the aqueous recovered solution containing the demetalizing composition for hydrocarbon oil, are supplemented; or when the concentration of the above-mentioned demetalizing agents is less than the prescribed proportion of the demetalizing agent to the hydrocarbon oil, 0.001%~5% of the demetalizing agent, based on the aqueous recovered solution containing the demetalizing composition for hydrocarbon oil, is supplemented.

The conventional electrically desalting process is carried out under the following conditions: desalting temperature of 50 to 150° C., and strong electric field of 500 to 1500 V/cm with residence time of 5 to 200 minutes and/or weak electric field of 50 to 500 V/cm with residence time of 1 to 60 minutes; the hydrocarbon oil is sufficiently mixed with 2-20% water based on the amount of the hydrocarbon oil and the desired amount of the demetalizing composition for hydrocarbon oil or the aqueous solution thereof by means of a mixing valve or a static mixer at a temperature of 50 to 150° C. and a mixing pressure difference of 0.02 MPa to 1.0 MPa.

The mixing of the demetalizing composition for hydrocarbon oil or the aqueous solution thereof with the hydrocarbon oil is carried out by means of a emulsion shearing machine or a static mixer to control the diameters of oil-water particle in the range of 0.1 μm to 50 μm.

The mixing of the demetalizing composition for hydrocarbon oil or the aqueous solution thereof with the hydrocarbon oil is carried out by means of film reactor having a film with the pore size of from 0.1 μm to 50 μm, and the film being selected from the group consisting of metal film, inorganic film and solvent resistance polyolefin film.

The recycling process for removing metal ions from hydrocarbon oil according to the present invention can efficiently overcome the disadvantages of the conventional process for demetalizing hydrocarbon oil, in which, for example, the demetalizing agent is only used once and discharged with the desalted water, thereby polluting the environment and being of high cost. In the process of the present invention, the demetalizing composition for hydrocarbon oil can be recycled and consumption cost of demetalizing composition can be reduced to be less than 80% and the production cost of hydrocarbon oil can be reduced to below 60%. The efficiency of the demetalizing agents can be kept by adjusting the content of components. At the same time, the residues of the metal salt can be treated to get the qualified product of metal salt and thus the residues to metal salt are utilized effectively. Accordingly, the present invention has the advantage of less amount of discharged waste water, waste residues and waste gas, environmental friendliness and higher efficiency of demetalization.

BRIEF DESCRIPTION OF THE DRAWING

FIG. 1 is a flow diagram showing the recycling process for demetalizing hydrocarbon oil according to the present invention, in which:

Figure 1:
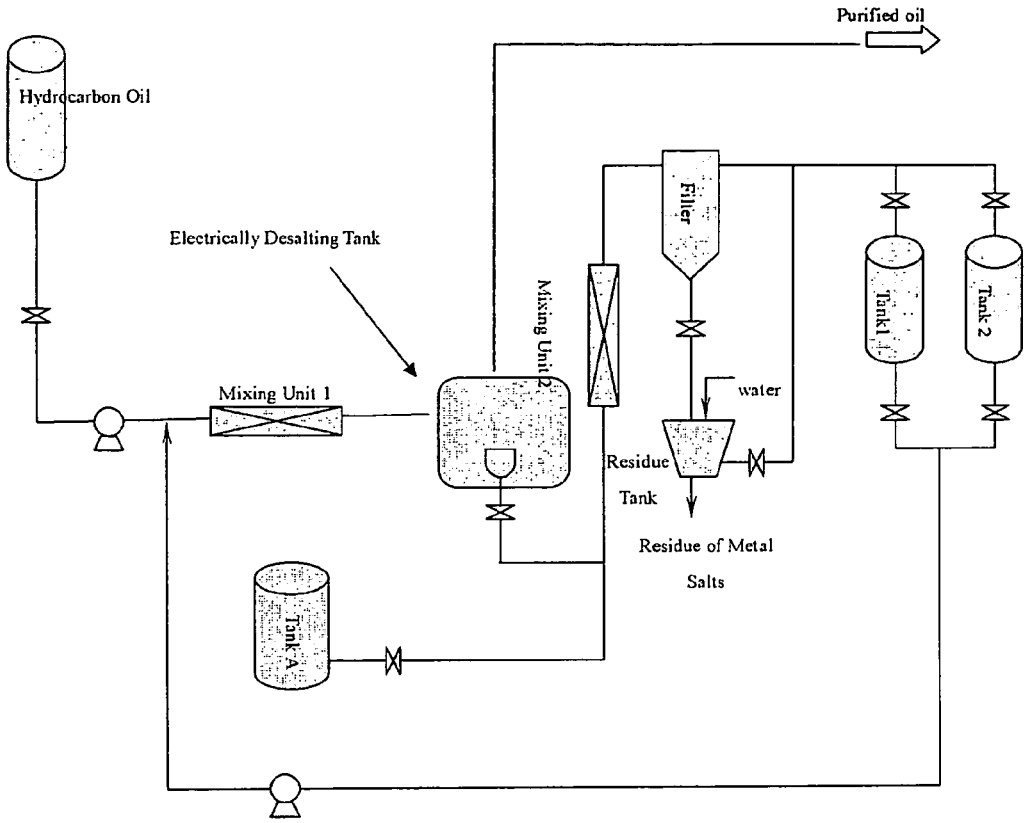

Mixing units 1 and 2 are both the mixing equipments;

Tank A is the tank for holding the precipitating agent;

Tank 1 and 2 are both the tank for holding demetalizing composition for hydrocarbon oil;

Filter is the solid-liquid separator; and

Purified oil is the hydrocarbon oil after being demetalizated.

DETAILED DESCRIPTION OF THE INVENTION

The present invention will be described in detailed with reference to the drawing and by the following examples. However, the present invention can not be construed to be limited by the examples. The specific embodiments of the invention can be determined according to the technical solutions and the practice.

Example 1

The demetalizing composition for hydrocarbon oil:

10% demetalizing agent+90% demulsifier+0% demetalizing aid;

Atmosphere $3^{rd}$ side cut fraction oil: Calcium (Ca) 37.3 μg/g, Magnesium (Mg) 3.13 μg/g, Sodium (Na) 21.8 μg/g, Vanadium (V) 12.6 μg/g, and Sulfur (S) 1295 μg/g;

Atmosphere $3^{rd}$ side cut fraction oil, the demetalizing composition for hydrocarbon oil in an amount of 0.002% by weight based on the atmosphere $3^{rd}$ side cut fraction oil and water in an amount of 5% by weight based on the atmosphere $3^{rd}$ side cut fraction oil were mixed in the static mixer for 2 minutes at a temperature of 100° C. and at a mixing pressure difference of 0.5 MPa. The diameter of the oil-water particle was controlled in the range of 0.11 to 50 μm. The mixture was then fed into the electrically desalting tank. At the desalting temperature of 100° C. and under strong/week electric field of 1500/100 V/cm, the mixture was treated for 20/10 minutes, respectively. After separation into the oil phase and water phase the purified oil was analyzed to find that: the content of calcium/the percentage of the demetalization of calcium 1.5 μg/g/95.9%, the content of magnesium/the percentage of the demetalization of magnesium 0.389 μg/g/87.5%, the content of sodium/the percentage of the demetalization of sodium 0.8 μg/g/96.3%, the content of vanadium/the percentage of the demetalization of vanadium 0.412 μg/g/96.7%, and the content of sulfur 1281 μg/g. The separated desalted water was tested by GB7476-87 method (the content of calcium in water is tested by EDTA titration method), and as a result, the content of calcium was found to be 0.3%. After the desalted water was mixed with and replaced by the precipitating agent of sulfuric acid in a molar ratio of 2.5:1 at a temperature of 80° C., a solution of the demetalizing composition for hydrocarbon oil having metal salt precipitate was obtained. The solution was then centrifuged for 5 minutes at ambient temperature and pressure with the revolving speed of 3000 rpm, and then was filtered with qualitative filter at ambient temperature and pressure. The filter liquor, i.e., the aqueous recovered solution containing the demetalizing composition for hydrocarbon oil, was found to have the demetalizing agent in a concentration of 1.6%. The filter residue, i.e., calcium sulfate, was then washed with 5% water based on the amount of calcium sulfate under ambient temperature until the pH value of the washed water was 5-7. It was then subjected to gravitational settling under the ambient temperature and normal pressure, and the obtained residue was dried at a temperature of 120° C. until the water content thereof was less than 1%. It was found that the content of calcium sulfate was to be 92.7%, which meets the quality standard of plaster for construction.

According to the above-mentioned procedure, the desired aqueous recovered solution containing the demetalizing composition for hydrocarbon oil was mixed with the atmosphere $3^{rd}$ side cut fraction oil with the mixing ratio of the aqueous recovered solution and the atmosphere $3^{rd}$ side cut fraction oil being 1.5% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $10^{th}$ recycle. The effect of recycling use of the aqueous recovered solution containing the demetalizing composition for hydrogen oil was shown in Table 1.

It can be seen from Table 1 that, by supplementing the demetalizing composition for hydrogen oil or by supplementing water, the demulsifier and the demetalizing aid, the aqueous solution of the demetalizing composition for hydrocarbon oil did not have any effect on the demetalization of the atmosphere $3^{rd}$ side cut fraction oil.

In Table 1, the demetalizing agents, inter-changeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

TABLE 1

| Recycle No. | Metal content in purified oil (μ/g) Ca | Mg | Na | V | S | Content of demetalizing agent in aqueous recovered solution (%) | Content of $CaSO_4$ (%) | Remarks |
|---|---|---|---|---|---|---|---|---|
| $2^{nd}$ | 2.4 | 0.43 | 0.59 | 0.42 | 1300 | 1.6 | 93.2 | / |
| $3^{rd}$ | 8.2 | 0.44 | 0.92 | 0.43 | 1310 | 1.8 | 92.7 | / |
| $4^{th}$ | 7.6 | 0.42 | 0.52 | 0.39 | 1289 | 2.3 | 92.2 | Water 34%, demulsifier 0.001%, demetalizing aid 0.001% were supplemented |
| $5^{th}$ | 2.5 | 0.46 | 0.64 | 0.43 | 1328 | 1.5 | 94.3 | / |
| $6^{th}$ | 2.8 | 0.37 | 0.8 | 0.46 | 1280 | 3.7 | 93.6 | Water 146%, demulsifier 0.005%, demetalizing aid 0.008% were supplemented |
| $7^{th}$ | 3.4 | 0.38 | 0.68 | 0.41 | 1294 | 1.7 | 92.7 | / |
| $8^{th}$ | 6.3 | 0.41 | 0.63 | 0.40 | 1305 | 1.0 | 92.8 | demetalizing composition 0.005% was supplemented |
| $9^{th}$ | 2.6 | 0.35 | 0.70 | 0.52 | 1322 | 1.6 | 92.6 | / |
| $10^{th}$ | 3.8 | 0.36 | 0.52 | 0.49 | 1305 | 1.8 | 92.1 | / |

Example 2

The demetalizing composition for hydrocarbon oil:

50% demetalizing agent+25% demulsifier+25% demetalizing aid;

Crude oil: Ca 260 μg/g, Mg 1.64 μg/g, Na 4.8 μg/g, V 1.6 μg/g, and Fe 8.6 μg/g;

Crude oil, the demetalizing composition for hydrocarbon oil in an amount of 0.8% by weight based on the crude oil and water in an amount of 10% based on the crude oil were mixed in the static mixer for 30 minutes at a temperature of 60° C. and at a pressure of 0.1 MPa. The mixture was then fed into the electrically desalting tank. At the desalting temperature of 50° C. and under strong/week electric field of 1000/500 V/cm, the mixture was treated for 60/20 minutes, respectively. After separation into the oil phase and water phase, the purified oil was analyzed to find the content of calcium/the percentage of the demetalization of calcium 25.8 μg/g/90.1%, the content of magnesium/the percentage of the demetalization of magnesium 0.432 μg/g/73.7%, the content of sodium/the percentage of the demetalization of sodium 2.3 μg/g/52.1%, the content of vanadium/the percentage of the demetalization of vanadium 0.442 μg/g/72.4%, and the content of iron 5.68 μg/g/34.0%. The separated desalted water was tested by GB7476-87 method (the content of calcium in water is tested by EDTA titration method), and as a result, the content of calcium was found to be 0.25%. After the desalted water was mixed with and replaced by the precipitating agent of sulfonic acid in a molar ratio of 1:1 at a temperature of 60° C., a solution of the demetalizing composition for hydrocarbon oil having calcium sulfonate precipitate was obtained. The solution was then filtered by a filter at a temperature of 60° C. and at a pressure of 0.15 MPa. The filter liquor, i.e., the aqueous recovered solution containing the demetalizing composition for hydrocarbon oil, was found to have the demetalizing agent in a concentration of 2.3%. The filter residue, i.e., calcium sulfonate, was then washed with 50% water based on the amount of calcium sulfonate at a temperature of 55° C. until the pH value of the washed water was 5-7. It was then subjected to the centrifugal settling at a pressure of 0.15 MPa and at a temperature of 55° C. with the revolving speed of 2000 rpm and the obtained residue was dried at a temperature of 100° C. until the water content thereof was less than 1%. The content of calcium sulfonate was found to be 95.2%.

According to the above-mentioned procedure, the desired aqueous recovered solution containing the demetalizing composition for hydrocarbon oil was mixed with the crude oil with the mixing ratio of the aqueous recovered solution and the crude oil being 90% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{th}$ recycle. The effect of recycling use of the aqueous recovered solution containing the demetalizing composition for hydrogen oil was shown in Table 2.

TABLE 2

| Recycle No. | Metal content in purified oil (μg/g) Ca | Mg | Fe | Na | V | Content of demetalizing agent in aqueous recovered solution (%) | content of calcium sulfonate (%) | Remarks |
|---|---|---|---|---|---|---|---|---|
| 4th | 42.9 | 0.55 | 6.12 | 0.53 | 0.65 | 2.6 | 98.2 | / |
| 8th | 35.6 | 0.60 | 4.42 | 1.48 | 0.75 | 2.8 | 97.5 | / |
| 10th | 38.2 | 0.58 | 4.04 | 1.41 | 0.79 | 1.7 | 97.2 | Demetalizing composition 0.001% was supplement |
| 15th | 24.1 | 0.59 | 5.92 | 2.65 | 0.69 | 1.5 | 98.3 | Demetalizing composition 0.05% was supplemented |
| 20th | 47.3 | 0.59 | 3.21 | 1.53 | 0.73 | 4.7 | 97.6 | Water 231%, demulsifier 0.01%, demetalizing aid 0.01% were supplemented |
| 25th | 36.9 | 0.70 | 3.83 | 2.64 | 0.86 | 1.1 | 97.3 | Demetalizing composition 0.002% was supplemented |
| 30th | 28.3 | 0.56 | 4.33 | 2.08 | 0.62 | 1.0 | 98.1 | Demetalizing composition 0.01% was supplemented |
| 35th | 27.9 | 0.78 | 4.18 | 2.25 | 0.89 | 6.9 | 95.8 | Water 340%, demulsifier 0.005%, demetalizing aid 0.008% were supplemented |
| 40th | 42.0 | 0.83 | 5.49 | 1.31 | 0.83 | 7.3 | 95.5 | Water 231%, demulsifier 0.02%, demetalizing aid 0.02% were supplemented |

It can be seen from Table 2 that, by supplementing the demetalizing composition for hydrogen oil or by supplementing water, the demulsifier and the demetalizing aid during the 40 recycles, the aqueous solution of the demetalizing composition for hydrocarbon oil did not haste any effect on the demetalization of crude oil.

In Table 2, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 3

The demetalizing composition for hydrocarbon oil:

99.5% demetalizing agent+0% demulsifier+0.5% demetalizing aid;

Crude oil: Ca 712 μg/g, Mg 5.52 μg/g, Fe 17.6 μg/g, Na 60 μg/g, and V 3.15 μg/g;

Crude oil and the demetalizing composition for hydrocarbon oil in an amount of 2% by weight based on the crude oil, water in an amount of 20% based on the crude oil were sheared by emulsion shearing machine at a temperature of 50° C. and a pressure of 0.5 MPa until the diameter of oil-water particle was in the range of 0.1 μm to 50 μm. The mixture was then fed into the electrically desalting tank. At the desalting temperature of 150° C. and under strong/week electric field of 500/50 V/cm, the mixture was treated for 200/60 minutes, respectively. After separation into the oil phase and water phase, the purified oil was analyzed to find the content of calcium/the percentage of the demetalization of calcium 45.8 μg/g/93.6%, the content of magnesium/the percentage of the demetalization of magnesium 0.68 μg/g/87.7%, the content of sodium/the percentage of the demetalization of sodium 3.3 μg/g/94.5%, the content of vanadium/the percentage of the demetalization of vanadium 0.35 μg/g/88.4%, the content of iron 8.1 μg/g/54.0%. The separated desalted water was tested by GB7476-87 method (the content of calcium in water is tested by EDTA titration method), and as a result, the content of calcium was found to be 6.2%. After the desalted water was mixed with and replaced by the precipitating agent of phosphoric acid in a molar ratio of 5:1 at a temperature of 150° C., a solution of the demetalizing composition for hydrocarbon oil having calcium phosphate was obtained. The solution was then filtered by a suction filter at a temperature of 30° C. and a pressure of −0.75 MPa. The filter liquor, i.e., the aqueous recovered solution containing the demetalizing composition for hydrocarbon oil, was found to have the demetalizing agent in a concentration of 4.2%. The filter residue, i.e., calcium phosphate, was then washed with 100% water based on the amount of calcium phosphate at a temperature of 100° C. until the pH value of the washed water was 7. It was then subjected to filtration at a temperature of 100° C. and a pressure of 1 MPa and the obtained residue was dried at a temperature of 80° C. until the water content thereof was less than 1%. The content of calcium phosphate was found to be 77.6%.

According to the above-mentioned procedure, the desired aqueous recovered solution containing the demetalizing composition for hydrocarbon oil was mixed with the crude oil with the mixing ratio of the aqueous recovered solution and the crude oil being 55% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $30^{th}$ recycle. The effect of recycling use of the aqueous recovered solution containing the demetalizing composition for hydrogen oil was shown in Table 3.

TABLE 3

| Recycle No. | Metal content in purified oil (μg/g) Ca | Mg | Fe | Na | V | Content of demetalizing agent in aqueous recovered solution (%) | Content of calcium phosphate (%) | Remarks |
|---|---|---|---|---|---|---|---|---|
| 5th | 51.4 | 0.73 | 12.4 | 2.6 | 0.61 | 8.3 | 88.2 | Water 500%, demulsifier 0.015%, demetalizing aid 0.012% were supplemented |
| 10th | 36.8 | 0.85 | 7.6 | 1.8 | 0.40 | 6.9 | 72.5 | Water 400%, demulsifier 0.008%, demetalizing aid 0.018% were supplemented |
| 15th | 39.3 | 0.36 | 9.8 | 2.1 | 0.31 | 2.4 | 75.2 | Demetalizing composition 0.1% was supplemented |
| 20th | 63.1 | 0.66 | 9.1 | 2.8 | 0.59 | 1.8 | 70.7 | Demetalizing composition 0.5% was supplemented |
| 25th | 46.5 | 0.75 | 5.6 | 3.4 | 0.48 | 0.6 | 76.4 | Demetalizing composition 1.5% was supplemented |
| 30th | 53.6 | 0.84 | 8.9 | 3.2 | 0.52 | 0.3 | 79.7 | Demetalizing composition 3.0% was supplemented |

It can be seen from Table 3 that, by supplementing the demetalizing composition for hydrogen oil or by supplementing water, the demulsifier and the demetalizing aid during the 30 recycles, the aqueous solution of the demetalizing composition for hydrocarbon oil did not have any effect on the demetalization of crude oil with high metal content.

In Table 3, the demetalizing agents, interchangeable with each other, can be any one selected from the group consisting of formic acid, acetic acid, propionic acid, butyric acid acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 4

The demetalizing composition for hydrocarbon oil:

75% demetalizing agent+10% demulsifier+15% demetalizing aid;

Crude oil: Ca 1380 μg/g, Mg 9.32 μg/g, Na 302 μg/g, V 9.44 μg/g, and Fe 95.3 μg/g;

Crude oil and the demetalizing composition for hydrocarbon oil in an amount of 5% by weight based on the crude oil, and water in an amount of 15% based on the crude oil were mixed by the film reactor made of the metal film with the film pore size of 0.1 μm to 50 μm at a temperature of 125° C. and a pressure of 0.3 MPa. The mixture was then fed into the electrically desalting tank. At the desalting temperature of 125° C. and under strong/week of 1200/400 V/cm, the mixture was treated for 5/1 minutes, respectively. After separation into the oil phase and water phase, the purified oil was analyzed to find the content of calcium/the percentage of the demetalization of calcium 67.8 μg/g/95.0%, the content of magnesium/the percentage of the demetalization of magnesium 0.98 μg/g/89.5%, the content of sodium/the percentage of the demetalization of sodium 2.3 μg/g/99.1%, the content of vanadium/the percentage of the demetalization of vanadium 1.01 μg/g/89.4%, and the content of iron 26.1 μg/g/72.6%. The separated desalted water was tested by GB7476-87 method (the content of calcium in water is tested by EDTA titration method), and as a result, the content of calcium was found to be 6.7%. After the desalted water was mixed with and replaced by the precipitating agent of hydrofluoric acid in a molar ratio of 10:1 at a temperature of 30° C. the solution of demetalizing composition for hydrocarbon oil containing calcium fluoride was obtained. The solution was then filtered by a liquid revolving type oil-water separator at a temperature of 30° C. and at a pressure of 0.02MPa. The filter liquor, i.e. the aqueous recovered solution containing the demetalizing composition for hydrocarbon oil, was found to have the demetalizing agent in a concentration of 8.3%. The filter residue, i.e., calcium fluoride, was then washed with 75% water based on the amount of calcium fluoride at a temperature of 75° C. until the pH value of the washed water was 5-7. It was then subjected to filtration at a temperature of 75° C. and at a pressure of −0.5 MPa and the obtained residue was dried at a temperature of 150° C. until the water content thereof was less than 1%. The content of calcium fluoride was found to be 92.6%.

According to the above-mentioned procedure, the desired aqueous recovered solution containing the demetalizing composition for hydrocarbon oil was mixed with the crude oil with the mixing ratio of the aqueous recovered solution and the crude oil being 55% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $30^{th}$ recycle. The effect of recycling use of the aqueous recovered solution containing the demetalizing composition for hydrogen oil was shown in Table 4.

TABLE 4

| Recycle | Metal content in purified oil (μg/g) | | | | | Content of demetalizing agent in aqueous recovered | Content of calcium | |
|---|---|---|---|---|---|---|---|---|
| No. | Ca | Mg | Fe | Na | V | solution (%) | fluoride (%) | Remarks |
| $5^{th}$ | 53.2 | 1.32 | 34.1 | 1.8 | 1.56 | 5.3 | 88.2 | Demetalizing composition 1% was supplemented |
| $10^{th}$ | 61.4 | 0.88 | 29.8 | 0.7 | 2.11 | 2.5 | 92.5 | Demetalizing composition 5% was supplemented |
| $15^{th}$ | 44.8 | 0.86 | 42.6 | 2.7 | 2.58 | 9.4 | 95.2 | Water 100%, demulsifier 0.003%, demetalizing aid 0.005% were supplemented |
| $20^{th}$ | 76.5 | 1.09 | 36.5 | 3.5 | 2.33 | 10.8 | 90.7 | Water 200%, demulsifier 0.012%, demetalizing aid 0.003% were supplemented |
| $25^{th}$ | 66.5 | 0.75 | 51.6 | 2.9 | 2.48 | 7.6 | 91.4 | Demetalizing composition 0.08% was supplemented |

It can be seen from Table 4 that by supplementing the demetalizing composition for hydrogen oil or by supplementing water, the demulsifier and the demetalizing aid during the 25 recycles, the aqueous solution of the demetalizing composition for hydrocarbon oil did not have any effect on the demetalization of crude oil with high metal content.

In Table 4, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 5

The demetalizing composition for hydrocarbon oil:

0.3% demetalizing agent+80% demulsifier+19.7% water;

Diesel oil: Ca 27.3 μg/g, Mg 0.38 μg/g, Na 6.8 μg/g, and V 0.6 μg/g;

Diesel oil, the demetalizing composition for hydrocarbon oil in an amount of 0.002% by weight based on diesel oil, and water in an amount of 2% based on diesel oil were mixed by the mixer at a temperature of 50° C. and a pressure of 0.02 MPa for 15 minutes. The mixture was then fed into the electrically desalting tank. At the desalting temperature of 50° C. and under strong/week electric field of 800/80 V/cm, the mixture was treated for 40/5 minutes, respectively. After separation into the oil phase and water phase, the purified oil was analyzed to find the content of calcium/the percentage of the demetalization of calcium 1.5 μg/g/94.5%, the content of magnesium less than 0.2 μg/g, the content of sodium less than 0.5 μg/g, and the content of vanadium less than 0.2 μg/g. The content of calcium in the separated desalted water was found to be 0.02%. After the desalted water was mixed with and replaced by the precipitating agent of sulfuric acid in a molar ratio of 1:1 at the ambient temperature, the solution of demetalizing composition for hydrocarbon oil containing metal precipitate was obtained. The solution was then centrifuged at a temperature of 20° C. and at normal pressure with the revolving speed of 3000 rpm for 5 minutes and then suction filtered at a temperature of 20° C. and at a pressure of −0.25 MPa. The filter liquor, i.e., the aqueous recovered solution containing the demetalizing composition for hydrocarbon oil, was found to have the demetalizing agent in a concentration of 0.6%. The filter residue, i.e., calcium sulfate, was then washed with 200% water based on of the amount of calcium fluoride at a temperature of 25° C. until the pH value of the washed water was 5-7. It was then subjected to suction filtration at a temperature of 25° C. and at a pressure of −0.75 MPa and the obtained residue was dried at a temperature of 175° C. until the water content thereof was less than 1%. The content of calcium sulfate was found to be 98.2%, which meets the quality standard of plaster for construction.

According to the above-mentioned procedure, the desired aqueous recovered solution containing the demetalizing composition for hydrocarbon oil was mixed with the crude oil with the mixing ratio of the aqueous recovered solution and the crude oil being 0.2% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{th}$ recycle. The effect of recycling use of the aqueous recovered solution containing the demetalizing composition for hydrogen oil was shown in Table 5.

TABLE 5

| Recycle No. | Metal content in purified oil ( μg/g) Ca | Mg | Na | V | Content of demetalizing agent in aqueous recovered solution (%) | Content of $CaSO_4$ (%) | Remarks |
|---|---|---|---|---|---|---|---|
| $5^{th}$ | 1.2 | <0.2 | 0.4 | <0.2 | 1.8 | 98.2 | Water 260%, demulsifier 0.002%, demetalizing aid 0.003% were supplemented |
| $10^{th}$ | 2.0 | <0.2 | 0.6 | <0.2 | 1.5 | 97.5 | Water 200%, demulsifier 0.004%, demetalizing aid 0.006% were supplemented |
| $20^{th}$ | 1.7 | <0.2 | 0.4 | <0.2 | 0.4 | 97.2 | Demetalizing composition 0.4% was supplemented |
| $30^{th}$ | 1.7 | <0.2 | 0.8 | <0.2 | 0.2 | 98.3 | Demetalizing composition 0.8% was supplemented |
| 40th | 1.5 | <0.2 | 0.5 | <0.2 | 0.2 | 97.6 | Demetalizing composition 0.8% was supplemented |

It can be seen from Table 5 that, by supplementing the demetalizing composition for hydrogen oil or by supplementing water, the demulsifier and the demetalizing aid during the 40 recycles, the aqueous solution of the demetalizing composition for hydrocarbon oil did not have any effect on the demetalization of diesel oil.

In Table 5, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 6

The demetalizing composition for hydrocarbon oil:

40% demetalizing agent+50% demetalizing aid+10% water:

Crude oil: Ca 260 μg/g, Mg 1.64 μg/g, Na 4.8 μg/g, V 1.6 μg/g, and Fe 8.6 μg/g;

Crude oil, the demetalizing composition for hydrocarbon oil in an amount of 45% by weight based on the crude oil, and water in an amount of 12% of the crude oil were mixed in the static mixer for 10 minutes at a temperature of 130° C. and at a pressure of 0.08 MPa. The diameter of the oil-water particle was controlled in the range of 0.1 to 50 μm. The mixture was then fed into the electrically desalting tank. At a temperature of 90° C. and under strong/week of 900/300 V/cm, the mixture was treated for 100/40 minutes, respectively. After separation into the oil phase and water phase, the purified oil was analyzed to find the content of calcium/the percentage of the demetalization of calcium 20.9 μg/g/92.1%, the content of magnesium/the percentage of the demetalization of magnesium 0.46 μg/g/72%, the content of sodium/the percentage of the demetalization of sodium 2.1 μg/g/56.3%, the content of vanadium/the percentage of the demetalization of vanadium 0.52 μg/g/67.5%, and the content of iron 3.57 μg/g/58.5%. The content of calcium in the separated desalted water was found to be 0.32%. After the desalted water was mixed with and replaced by the precipitating agent of sulfonic acid in a molar ratio of 1.5:1 at a temperature of 130° C., the solution containing the precipitate of calcium sulfonate of demetalizing composition for hydrocarbon oil was obtained. The solution was then filtered by the filter at a temperature of 130° C. and at a pressure of 0.25 MPa. The filter liquor, i.e., the aqueous recovered solution containing the demetalizing composition for hydrocarbon oil, was found to be have the demetalizing agent in a concentration of 1.8%. The filter residue, i.e., calcium sulfonate, was then washed with 20% water based on the amount of calcium sulfonate at a temperature of 35° C. until the pH value of the washed water was 5-7. It was then subjected to centrifugal separation at a temperature of 35° C. and at the normal pressure with the revolving speed of 3500 rpm, and the obtained residue was dried at a temperature of 160° C. until the water content thereof was less than 1%. The content of calcium sulfonate was found to be 95.2%.

The effect of recycling use of the aqueous recovered solution containing the demetalizing composition for hydrogen oil was shown in Table 6.

TABLE 6

| Recycle No. | Metal content in purified oil (μg/g) Ca | Mg | Fe | Na | V | Content of demetalizing agent in aqueous recovered solution (%) | Content of calcium sulfonate (%) | Remarks |
|---|---|---|---|---|---|---|---|---|
| 5th | 18.7 | 0.35 | 6.12 | 2.5 | 0.75 | 2.8 | 98.2 | Water 55.6%, demulsifier 0.005%, demetalizing aid 0.01% were supplemented |
| 10th | 23.8 | 0.48 | 4.04 | 1.4 | 0.69 | 1.3 | 97.2 | Demetalizing composition 0.12% was supplemented |
| 15th | 24.1 | 0.52 | 5.92 | 2.2 | 0.59 | 0.5 | 98.3 | Demetalizing composition 0.5% was supplemented |
| 20th | 19.4 | 0.59 | 3.21 | 1.5 | 0.71 | 4.7 | 97.6 | Water 165%, demulsifier 0.004%, demetalizing aid 0.012% were supplemented |

It can be seen from Table 6 that, by supplementing the demetalizing composition for hydrogen oil or by supplementing water, the demulsifier and the demetalizing aid during the 20 recycles, the aqueous solution of the demetalizing composition for hydrocarbon oil did not have any effect on the demetalization of crude oil.

In Table 6, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 7

The demetalizing composition for hydrocarbon oil:

95% demetalizing agent+2% demulsifier+2% demetalizing aid+1% water:

Residual oil: Ca 1469 μg/g, Mg 19.3 μg/g, Fe 59.5 μg/g, Na 10 μg/g, and V 21.4 μg/g;

Residual oil, the demetalizing composition for hydrocarbon oil in an amount of 99.5% by weight based on the residual oil, and water in an amount of 16% based on the residual oil were mixed by emulsion shearing machine at a temperature of 75° C. and at a pressure of 0.6 MPa. The diameter of the oil-water particle was controlled in the range of 0.1 to 50 μm. The mixture was then fed into the electrically desalting tank. At the desalting temperature of 110° C. and under strong/week electric field of 1100/200 V/cm, the mixture was treated for 150/30 minutes, respectively. After separation into the oil phase and water phase, the purified oil was analyzed to find the content of calcium/the percentage of the demetalization of calcium 32 μg/g/97.8%, the content of magnesium/the percentage of the demetalization of magnesium 1.64 μg/g/91.5%, the content of sodium/the percentage of the demetalization of sodium 2.5 μg/g/75%, the content of vanadium/the percentage of the demetalization of vanadium 1.92 μg/g/91%, and the content of iron 17.48 μg/g/70.6%. The content of calcium in the separated desalted water was found to be 1.4%. After the desalted water was mixed with and replaced by the precipitating agent of phosphoric acid in a molar ratio of 6.5:1 at a temperature of 110° C., the solution containing the precipitate of calcium phosphate of demetalizing composition for hydrocarbon oil was obtained. The solution was then filtered by a liquid revolving type oil-water separator at a temperature of 110° C. and at a pressure of 0.35 MPa. The filter liquor, i.e., the aqueous recovered solution containing the demetalizing composition for hydrocarbon oil, was found to be have the demetalizing agent in a concentration of 6.8%. The filter residue, i.e., calcium phosphate, was then washed with water in an amount of 100% of calcium phosphate at a temperature of 45° C. until the pH value of the washed water was 5-7. It was then subjected to centrifugal separation at a temperature of 45° C. and a pressure of 0.25 MPa with revolving speed of 3500 rpm, and the obtained residue was dried at a temperature of 200° C. until the water content thereof was less than 1%. The content of calcium phosphate was found to be 75.2%.

The effect of recycling use of the aqueous recovered solution containing the demetalizing composition for hydrogen oil was shown in Table 7.

TABLE 7

| Recycle No. | Metal content in purified oil (μg/g) Ca | Mg | Fe | Na | V | Content of demetalizing agent in aqueous recovered solution (%) | Content of calcium sulfonate (%) | Remarks |
|---|---|---|---|---|---|---|---|---|
| 5th | 35.8 | 1.88 | 21.6 | 3.7 | 1.35 | 12.9 | 77.8 | Water 85%, demulsifier 0.0025%, demetalizing aid 0.008% were supplemented |
| 10th | 40.7 | 1.58 | 20.5 | 2.9 | 1.45 | 10.6 | 78.1 | Water 65%, demulsifier 0.006%, demetalizing aid 0.1% were supplemented |
| 20th | 44.3 | 1.94 | 18.9 | 2.7 | 1.78 | 4.3 | 76.4 | Demetalizing composition 4.8% was supplemented |

It can be seen from Table 7 that, by supplementing the demetalizing composition for hydrogen oil or by supplementing water, the demulsifier and the demetalizing aid during the 20 recycles, the aqueous solution of the demetalizing composition for hydrocarbon oil did not have any effect on the demetalization of residual oil.

In Table 7, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4 AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 8 the demetalizing composition for hydrocarbon oil:

10% demetalizing agent+5% demulsifier+80% demetalizing aid+5% water;

Reduced 4th side cut fraction oil: Ca 60 μg/g, Mg 2.99 μg/g, Na 2.8 μg/g, V 2.1 μg/g, and Fe 4.3 μg/g;

the Reduced 4th side cut fraction oil, the demetalizing composition for hydrocarbon oil in an amount of 20% by weight based on the Reduced 4th side cut fraction oil, and water in an amount of 14% based on the Reduced 4th side cut fraction oil were mixed by the film reactor made of the enamel film with film pore size of 0.1 μm to 50 μm at a temperature of 110° C. and a pressure of 0.8 MPa. The mixture was then fed into the electrically desalting tank. At the desalting temperature of 60° C. and under strong/week electric field of 700/150 V/cm the mixture was treated for 10/15 minutes, respectively. After separation into the oil phase and water phase, the purified oil was analyzed to find the content of calcium/the percentage of the demetalization of calcium 9.7 μg/g/83.8%, the content of magnesium/the percentage of the demetalization of magnesium 0.54 μg/g/81.9%, the content of sodium/the percentage of the demetalization of sodium 0.5 μg/g/82.1%, the content of vanadium/the percentage of the demetalization of vanadium 0.89 μg/g/57.6%, and the content of iron 3.8 μg/g/11.6%. The content of calcium in the separated desalted water was found to be 0.0023%. After the desalted water was mixed with and replaced by the precipitating agent of hydrofluoric acid in a molar ratio of 2:1 at a temperature of 90° C., the solution of demetalizing composition for hydrocarbon oil containing calcium fluoride was obtained. The solution was then filtered by liquid revolving type oil-water separator at a temperature of 40° C. and at a pressure of −0.5 MPa. The filter liquor, i.e., the aqueous recovered solution containing the demetalizing composition for hydrocarbon oil, was found to have the demetalizing agent in a concentration of 0.2%. The filter residue, i.e., calcium fluoride was then washed with 150% water based on the amount of calcium fluoride at a temperature of 65° C. until the pH value of the washed water was 5-7. It was then subjected to centrifugal separation at a temperature of 65° C. and at a pressure of 0.4 MPa with a revolving speed of 3500 rpm and the obtained residue was dried at a temperature of 140° C. until the water content thereof was less than 1%. The content of calcium fluoride was found to be 85.2%.

The effect of recycling use of the aqueous recovered solution containing the demetalizing composition for hydrogen oil was shown in Table 8.

TABLE 8

| Recycle No. | Metal content in purified oil (μg/g) Ca | Mg | Fe | Na | V | Content of demetalizing agent in aqueous recovered solution (%) | Content of calcium fluoride (%) | Remarks |
|---|---|---|---|---|---|---|---|---|
| 5th | 13.3 | 0.56 | 2.7 | 0.8 | 0.72 | 0.8 | 83.5 | Water 3%, demulsifier 0.0025%, demetalizing aid 0.008% were supplemented |

TABLE 8-continued

| Recycle No. | Metal content in purified oil (μg/g) Ca | Mg | Fe | Na | V | Content of demetalizing agent in aqueous recovered solution (%) | Content of calcium fluoride (%) | Remarks |
|---|---|---|---|---|---|---|---|---|
| 10th | 8.4 | 0.68 | 3.5 | 1.7 | 1.31 | 0.09 | 84.1 | Demetalizing composition 2.1% was supplemented |
| 20th | 10.6 | 0.89 | 3.1 | 0.9 | 1.15 | 0.34 | 87.8 | Water 1%, demulsifier 0.006%, demetalizing aid 0.1% were supplemented |

It can be seen from Table 8 that, by supplementing the demetalizing composition for hydrogen oil or by supplementing water, the demulsifier and the demetalizing aid during the 20 recycles, the aqueous solution of the demetalizing composition for hydrocarbon oil did not have any effect on the demetalization of the reduced $4^{th}$ side cut fraction oil.

In Table 8, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 9

The demetalizing composition for hydrocarbon oil:

30% demetalizing agent+33% demulsifier+25% demetalizing aid+12% water:

Crude oil: Ca 178 μg/g, Mg 12.5 μg/g, Na 60.8 μg/g, V 7.1 μg/g, and Fe 42.3 μg/g;

The crude oil, the demetalizing composition for hydrocarbon oil in an amount of 60% by weight based on crude oil, and water in an amount of 4% based on crude oil were mixed in the static mixer for 8 minutes at a temperature of 100° C. and at a pressure of 0.06 MPa. The diameter of the oil-water particle was controlled in the range of 0.1 to 50 μm. The mixture was then fed into the electrically desalting tank. At a temperature of 100° C. and under strong/week of 1350/300 V/cm, the mixture was treated for 80/8 minutes, respectively. After separation into the oil phase and water phase, the purified oil was analyzed to find the content of calcium/the percentage of the demetalization of calcium 28.5 μg/g/84%, the content of magnesium/the percentage of the demetalization of magnesium 1.59 μg/g/84.8%, the content of sodium/the percentage of the demetalization of sodium 2.2 μg/g/96.4%, the content of vanadium/the percentage of the demetalization of vanadium 0.49 μg/g/93.1%, and the content of iron 5.7 μg/g/86.5%. The content of calcium in the separated desalted water was found to be 0.37%. After the desalted water was mixed with and replaced by the precipitating agent of sulfuric acid in a molar ratio of 2:1 at a temperature of 90° C., the solution containing the precipitate of calcium sulfonate of demetalizing composition for hydrocarbon oil was obtained. The solution was then filtered by a pressure filter at a temperature of 90° C. and a pressure of 0.25 MPa. The filter liquor, i.e., the aqueous recovered solution containing the demetalizing composition for hydrocarbon oil, was found to have the demetalizing agent in a concentration of 2.6%. The filter residue, i.e., calcium sulfonate, was then washed with 175% water based on the amount of calcium sulfonate at a temperature of 85° C., until the pH value of the washed water was 5-7. It was then subjected to centrifugal separation at a temperature of 85° C. and a pressure of 0.5 MPa and the obtained residue was dried at a temperature of 160° C. until the water content thereof was less than 1%. The content of calcium sulfonate was found to be 79.2%.

The effect of recycling use of the aqueous recovered solution containing the demetalizing composition for hydrogen oil was shown in Table 9.

TABLE 9

| Recycle No. | Metal content in purified oil (μg/g) Ca | Mg | Fe | Na | V | Content of demetalizing agent in aqueous recovered solution (%) | Content of calcium sulfonate (%) | Remarks |
|---|---|---|---|---|---|---|---|---|
| 5th | 30.8 | 2.47 | 8.6 | 0.7 | 0.52 | 2.9 | 85.9 | Water 1%, demulsifier 0.005%, demetalizing aid 0.01% were supplemented |

TABLE 9-continued

| Recycle No. | Metal content in purified oil (μg/g) Ca | Mg | Fe | Na | V | Content of demetalizing agent in aqueous recovered solution (%) | Content of calcium sulfonate (%) | Remarks |
|---|---|---|---|---|---|---|---|---|
| 10th | 25.4 | 2.52 | 5.1 | 1.5 | 0.47 | 1.1 | 83.2 | Demetalizing composition 3.5% was supplemented |
| 15th | 29.3 | 1.67 | 7.3 | 3.4 | 0.62 | 4.5 | 75.0 | Water 10%, demulsifier 0.005%, demetalizing aid 0.01% were supplemented |
| 20th | 35.7 | 1.84 | 4.9 | 4.1 | 0.39 | 6.6 | 80.8 | Water 30%, demulsifier 0.004%, demetalizing aid 0.012% were supplemented |

It can be seen from Table 9 that, by supplementing the demetalizing composition for hydrogen oil or by supplementing water, the demulsifier and the demetalizing aid during the 20 recycles, the aqueous solution of the demetalizing composition for hydrocarbon oil did not have any effect on the demetalization of the crude oil.

In Table 9, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 10

The demetalizing composition for hydrocarbon oil:

95% demetalizing agent+0% demulsifier+0% demetalizing aid+0.5% water;

Diesel oil: Ca 27.3 μg/g, Mg 0.38 μg/g, Na 6.8 μg/g, and V 0.6 μg/g;

The diesel oil, the demetalizing composition for hydrocarbon oil in an amount of 10% by weight based on diesel oil, and water in an amount of 5% based on diesel oil were mixed by the film reactor made of the insoluble polyolefin film with the film pore size of 0.1 μm to 50 μm at a temperature of 80° C. and a pressure of 0.03 MPa. The mixture was then fed into the electrically desalting tank. At the desalting temperature of 100° C. and under strong/week electric field of 850/80 V/cm, the mixture was treated for 30/5 minutes, respectively. After separation into the oil phase and water phase, the purified oil was analyzed to find the content of calcium/the percentage of the demetalization of calcium 2.5 μg/g/90.8%, the content of magnesium less than 0.2 μg/g, the content of sodium less than 1.3 μg/g/80.9%, and the content of vanadium less than 0.2 μg/g. The content of calcium in the separated desalted water was found to be 0.015%. After the desalted water was mixed with and replaced by the precipitating agent of citric acid in a molar ratio of 8.5:1 at a temperature of 50° C., the solution containing the precipitate was obtained. The solution was then filtered by a liquid revolving type oil-water separator at a temperature of 50° C. and a pressure of 0.07 MPa with the revolving speed of 3500 rpm. The filter liquor, i.e., the aqueous recovered solution containing the demetalizing composition for hydrocarbon oil, was found to have the demetalizing agent in a concentration of 0.85%. The filter residue, i.e., calcium citrate, was then washed with 50% water based on the amount of calcium citrate at a temperature of 25° C., until the pH value of the washed water was 5-7. It was then subjected to suction filtration at a temperature of 25° C. and a pressure of −0.25 MPa and the obtained residue was dried at a temperature of 190° C. until the water content thereof was less than 1%. The content of calcium citrate was found to be 97.8%.

According to the above-mentioned procedure, the desired aqueous recovered solution containing the demetalizing composition for hydrocarbon oil was mixed with the diesel oil with the mixing ratio of the aqueous recovered solution and the diesel oil being 8% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{th}$ recycle. The effect of recycling use of the aqueous recovered solution containing the demetalizing composition for hydrogen oil was shown in Table 10.

TABLE 10

| Recycle No. | Metal content in purified oil (μg/g) Ca | Mg | Na | V | Content of demetalizing agent in aqueous recovered solution (%) | Content of calcium citrate (%) | Remarks |
|---|---|---|---|---|---|---|---|
| 5th | 2.7 | <0.2 | 2.3 | <0.2 | 1.4 | 98.9 | Water 240%, demulsifier 0.003%, demetalizing aid 0.008% were supplemented |
| 10th | 3.0 | <0.2 | 1.8 | <0.2 | 1.9 | 97.5 | Water 300%, demulsifier 0.006%, demetalizing aid 0.02% were supplemented |
| 20th | 2.3 | <0.2 | 1.0 | <0.2 | 0.7 | 98.2 | Demetalizing composition 0.09% was supplemented |
| 30th | 2.4 | <0.2 | 1.4 | <0.2 | 0.5 | 98.3 | Demetalizing composition 0.4% was supplemented |
| 40th | 2.9 | <0.2 | 1.7 | <0.2 | 0.2 | 98.7 | Demetalizing composition 0.8% was supplemented |

It can be seen from Table 10 that, by supplementing the demetalizing composition for hydrogen oil or by supplementing water, the demulsifier and the demetalizing aid during the 40 recycles, the aqueous solution of the demetalizing composition for hydrocarbon oil did not have any effect on the demetalization of the diesel oil.

In Table 10, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 11

The demetalizing composition for hydrocarbon oil:

80% demetalizing agent+6% demulsifier+8% demetalizing aid+6% water;

Dirty oil: Ca 190 μg/g, Mg 7.5 μg/g, Fe 16.3 μg/g, and V 12.1 μg/g;

The dirty oil, the demetalizing composition for hydrocarbon oil in an amount of 50% by weight based on the dirty oil, and water in an amount of 10% based on the dirty oil were mixed by emulsion shearing machine at a temperature of 120° C. and at a pressure of 0.4 MPa. The diameter of the oil-water particle was controlled in the range of 0.1 to 50 μm. The mixture was then fed into the electrically desalting tank. At the desalting temperature of 140° C. and under strong/week electric field of 1400/500 V/cm, the mixture was treated for 60/6 minutes, respectively. After separation into the oil phase and water phase, the purified oil was analyzed to find the content of calcium/the percentage of the demetalization of calcium 45.2 g/g/76.2%, the content of magnesium/the percentage of the demetalization of magnesium 1.8 μg/g 76.0%, the content of vanadium/the percentage of the demetalization of vanadium 1.7 μg/g/86.0%, and the content of iron/the percentage of the demetalization of iron 7.8 μg/g/52.1%. The content of calcium in the separated desalted water was found to be 0.45%. After the desalted water was mixed with and replaced by the precipitating agent of sulfuric acid in a molar ratio of 1.5:1 at a temperature of 40° C., the solution containing the precipitate of calcium sulfate of demetalizing composition for hydrocarbon oil was obtained. The solution was then filtered by a liquid revolving type oil-water separator at a temperature of 60° C. and at a pressure of 0.07 MPa with the revolving speed of 3500 rpm. The filter liquor, i.e., the aqueous recovered solution containing the demetalizing composition for hydrocarbon oil, was found to be have the demetalizing agent in a concentration of 2.8%. The filter residue, i.e., calcium sulfate, was then washed with 100% water based on the amount of calcium sulfate at a temperature of 30° C. until the pH value of the washed water was 5 or 6 or 7. It was then subjected to suction filtration at a temperature of 25° C. and a pressure of −0.1 MPa, and the obtained residue was dried at a temperature of 190° C. until the water content thereof was less than 1%. The content of calcium sulfate was found to be 98.1%, which meets the quality standard of plaster for construction.

According to the above-mentioned procedure, the desired aqueous recovered solution containing the demetalizing composition for hydrocarbon oil was mixed with the dirty oil with the mixing ratio of the aqueous recovered solution and the dirty oil being 50% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{nd}$ recycle. The effect of recycling use of the aqueous recovered solution containing the demetalizing composition for hydrogen oil was shown in Table 11.

TABLE 11

| Recycle No. | Metal content in purified oil (μg/g) Ca | Mg | Fe | V | Content of demetalizing agent in aqueous recovered solution (%) | Content of $CaSO_4$ (%) | Remarks |
|---|---|---|---|---|---|---|---|
| 5th | 36.7 | 2.1 | 8.1 | 2.0 | 3.1 | 98.2 | Water 210%, demulsifier 0.003%, demetalizing aid 0.004% were supplemented |
| 10th | 38.9 | 1.6 | 6.5 | 1.8 | 3.5 | 98.3 | Water 350%, demulsifier 0.005%, demetalizing aid 0.008% were supplemented |
| 20th | 47.4 | 1.9 | 7.4 | 2.1 | 2.1 | 97.2 | Demetalizing composition 0.08% was supplemented |
| 30th | 41.9 | 2.2 | 5.1 | 1.9 | 1.8 | 96.8 | Demetalizing composition 0.5% was supplemented |
| 40th | 33.7 | 2.5 | 6.8 | 2.3 | 1.5 | 97.8 | Demetalizing composition 0.9% was supplemented |

It can be seen from Table 11 that, by supplementing the demetalizing composition for hydrogen oil or by supplementing water, the demulsifier and the demetalizing aid during the 40 recycles, the aqueous solution of the demetalizing composition for hydrocarbon oil did not have any effect on the demetalization of the dirty oil.

In Table 11, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 12

The demetalizing composition for hydrocarbon oil:

80% demetalizing agent+5% demulsifier+15% demetalizing aid;

Regenerated oil: Ca 80 μg/g. Mg 4.7 μg/g, V 9.2 μg/g, and Fe 4.3 μg/g;

The regenerated oil, the demetalizing composition for hydrocarbon oil in an amount of 0.2% by weight based on the regenerated oil, and water in an amount of 7% based on the regenerated oil were mixed in the static mixer for 0.5 minutes at a temperature of 120° C. and at a pressure of 0.2 MPa. The diameter of the oil-water particle was controlled in the range of 0.1 to 50 μm. The mixture was then fed into the electrically desalting tank. At the desalting temperature of 125° C. and under strong/week electric field of 1100/500 V/cm the mixture was treated for 40/8 minutes, respectively. After separation into the oil phase and water phase, the purified oil was analyzed to find the content of calcium/the percentage of the demetalization of calcium 17.6 μg/g/78%, the content of magnesium/the percentage of the demetalization of magnesium 0.8 μg/g/83%, the content of vanadium/the percentage of the demetalization of vanadium 0.7 μg/g/92.4%, and the content of iron the percentage of the demetalization of iron 1.8 μg/g/58.2%. The content of calcium in the separated desalted water was found to be 0.17%. After the desalted water was mixed with and replaced by the precipitating agent of sulfuric acid in a molar ratio of 1:1 at a temperature of 125° C., the solution containing the precipitate of metal salt of demetalizing composition for hydrocarbon oil was obtained. The solution was then filtered by a liquid revolving type oil-water separator at a temperature of 125° C. and a pressure of 0.7 MPa with the revolving speed of 3500 rpm. The filter liquor, i.e., the aqueous recovered solution containing the demetalizing composition for hydrocarbon oil, was found to be have the demetalizing agent in a concentration of 0.6%. The filter residue, i.e., calcium sulfate, which is then washed with water in an amount of 100% of calcium sulfate at a temperature of 30° C. until the pH value of the washed water was 5 or 6 or 7. It was then subjected to pressure filtration at a temperature of 25° C. and a pressure of 0.05 MPa, and the obtained residue was dried at a temperature of 190° C. until the water content thereof was less than 1%. The content of calcium sulfate was found to be 97.2%, which meets the quality standard of plaster for construction.

According to the above-mentioned procedure, the desired aqueous recovered solution containing the demetalizing composition for hydrocarbon oil was mixed with the regenerated oil with the mixing ratio of the aqueous recovered solution and the regenerated oil being 50% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{th}$ recycle. The effect of recycling use of the aqueous recovered solution containing the demetalizing composition for hydrogen oil was shown in Table 12.

TABLE 12

| Recycle No. | Metal content in purified oil (μg/g) Ca | Mg | Fe | V | Content of demetalizing agent in aqueous recovered solution (%) | Content of $CaSO_4$ (%) | Remarks |
|---|---|---|---|---|---|---|---|
| 5th | 16.7 | 1.1 | 2.1 | 0.7 | 1.1 | 96.8 | Water 210%, demulsifier 0.003%, demetalizing aid 0.01% were supplemented |
| 10th | 18.9 | 0.6 | 1.9 | 0.8 | 1.3 | 97.3 | Water 350%, demulsifier 0.005%, demetalizing aid 0.01% were supplemented |
| 20th | 17.4 | 0.9 | 2.4 | 1.1 | 0.5 | 97.2 | Demetalizing composition 0.08% was supplemented |
| 30th | 21.9 | 1.0 | 1.5 | 0.8 | 0.3 | 96.9 | Demetalizing composition 0.5% was supplemented |
| 40th | 23.7 | 0.8 | 1.8 | 0.9 | 0.2 | 97.8 | Demetalizing composition 0.9% was supplemented |

It can be seen from Table 12 that, by supplementing the demetalizing composition for hydrogen oil or by supplementing water, the demulsifier and the demetalizing aid during the 40 recycles, the aqueous solution of the demetalizing composition for hydrocarbon oil did not have any effect on the demetalization of the regenerated oil.

In Table 12, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 13

The demetalizing composition for hydrocarbon oil:

30% demetalizing agent+50% demulsifier+20% demetalizing aid;

Regenerated oil: Ca 63 μg/g, Mg 18.4 μg/g, and Fe 26.1 μg/g;

The regenerated oil, the demetalizing composition for hydrocarbon oil in an amount of 0.04% by weight based on the regenerated oil, and water in an amount of 4% based on the regenerated oil were mixed by the film reactor made of the enamel film with the film pore size of 0.1 μm to 50 μm at a temperature of 150° C. and a pressure of 0.3 MPa. The mixture was then fed into the electrically desalting tank. At the desalting temperature of 120° C. and under strong/week electric field of 1100/500 V/cm the mixture was treated for 30/10 minutes, respectively. After separation into the oil phase and water phase, the purified oil was analyzed to find the content of calcium/the percentage of the demetalization of calcium is 8.4 μg/g/86.7%, the content of magnesium/the percentage of the demetalization of magnesium 1.6 μg/g/91.3%, the content of iron/the percentage of the demetalization of iron 3.5 μg/g/86.6%. The content of calcium in the separated desalted water was found to be 0.09%. After the desalted water was mixed with and replaced by the precipitating agent of oxalic acid in a molar ratio of 2:1 at a temperature of 150° C., the solution of demetalizing composition for hydrocarbon oil containing calcium oxalate was obtained. The solution was then filtered by liquid revolving type oil-water separator at a temperature of 150° C., at a pressure of 1.0 MPa and a revolving speed of 4000 rpm. The filter liquor, i.e., the aqueous recovered solution containing the demetalizing composition for hydrocarbon oil, was found to have the demetalizing agent in a concentration of 0.15%. The filter residue, i.e., calcium oxalate, was then washed with water in an amount of 200% of calcium fluoride at a temperature of 50° C. until the pH value of the washed water was 5-7. It was then subjected to pressure filtration at a temperature of 100° C. and at a pressure of 0.75 MPa and the obtained residue was dried at a temperature of 200° C. until the water content thereof was less than 1%. The content of calcium oxalate was found to be 76.2%.

According to the above-mentioned procedure, the desired aqueous recovered solution containing the demetalizing composition for hydrocarbon oil was mixed with the regenerated oil with the mixing ratio of the aqueous recovered solution and the regenerated oil being 50% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{th}$ recycle. The effect of recycling use of the aqueous recovered solution containing the demetalizing composition for hydrogen oil was shown in Table 13.

TABLE 13

| Recycle No. | Metal content in purified oil (μg/g) Ca | Mg | Fe | Content of demetalizing agent in aqueous recovered solution (%) | Content of calcium oxalate (%) | Remarks |
|---|---|---|---|---|---|---|
| 5th | 6.7 | 1.9 | 5.1 | 0.18 | 77.8 | Water 250%, demulsifier 0.005%, demetalizing aid 0.002% were supplemented |
| 10th | 10.3 | 3.2 | 4.3 | 0.24 | 80.4 | Water 350%, demulsifier 0.005%, demetalizing aid 0.002% were supplemented |
| 20th | 9.6 | 2.6 | 2.8 | 0.13 | 75.6 | Demetalizing composition 0.06% was supplemented |
| 30th | 8.5 | 1.8 | 4.0 | 0.08 | 77.4 | Demetalizing composition 0.13% was supplemented |
| 40th | 7.9 | 2.3 | 3.6 | 0.04 | 76.8 | Demetalizing composition 0.18% was supplemented |

It can be seen from Table 13 that, by supplementing the demetalizing composition for hydrogen oil or by supplementing water, the demulsifier and the demetalizing aid during the 40 recycles, the aqueous solution of the demetalizing composition for hydrocarbon oil did not have any effect on the demetalization of the regenerated oil.

In Table 13, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80. SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

Example 14

The demetalizing composition for hydrocarbon oil:

40% demetalizing agent+20% demulsifier+0% demetalizing aid+40% water;

Dirty oil: Ca 120 μg/g, Mg 23.7 μg/g, V 8.9 μg/g, and Fe 8.1 μg/g;

Dirty oil, the demetalizing composition for hydrocarbon oil in an amount of 70% by weight based on the dirty oil, and water in an amount of 15% based on the dirty oil were mixed by the film reactor made of the metal film with the film pore size of 0.1 μm to 50 μm at a temperature of 120° C. and a pressure of 1 MPa. The mixture was then fed into the electrically, desalting tank. At the desalting temperature of 120° C. and under strong/week electric field of 750/250 V/cm, the mixture was treated for 60/6 minutes, respectively. After separation into the oil phase and water phase, the purified oil was analyzed to find the content of calcium/the percentage of the demetalization of calcium 32.8 μg/g/72.6%, the content of magnesium/the percentage of the demetalization of magnesium 8.3 μg/g/65.0%, the content of vanadium/the percentage of the demetalization of vanadium 1.2 μg/g/86.5%, and the content of iron/the percentage of the demetalization of iron 4.8 μg/g/40.7%. The content of calcium in the separated desalted water was found to be 0.25%. After the desalted water was mixed with and replaced by the precipitating agent of citric acid in a molar ratio of 8:1 at a temperature of 120° C., the solution of demetalizing composition for hydrocarbon oil containing calcium citrate was obtained. The solution was then filtered at a temperature of 30° C. and at a pressure of −1.0 MPa. The filter liquor, i.e., the aqueous recovered solution containing the demetalizing composition for hydrocarbon oil, was found to have the demetalizing agent in a concentration of 1.87%. The filter residue, i.e., calcium citrate, was washed with 80% water based on the amount of calcium citrate at a temperature of 80° C. until the pH value of the washed water was 5-7. It was then subjected to suction filtration at a temperature of 25° C. and at a pressure of −1.0 MPa and the obtained residue was dried at a temperature of 190° C. until the water content thereof was less than 1%. The content of calcium citrate was found to be 77.10%.

According to the above-mentioned procedure, the desired aqueous recovered solution containing the demetalizing composition for hydrocarbon oil was mixed with the dirty oil with the mixing ratio of the aqueous recovered solution and the dirty oil being 50% by weight. The mixing procedure, electrically desalting parameters, the determination of the metal content in the purified oil and the determination of the calcium content in the desalted water were the same as described as above. The obtained aqueous recovered solution was used for the $2^{nd}$ recycle to the $40^{th}$ recycle. The effect of recycling use of the aqueous recovered solution containing the demetalizing composition for hydrogen-oil was shown in Table 14.

TABLE 14

| Recycle No. | Metal content in purified oil (μg/g) Ca | Mg | Fe | V | Content of demetalizing agent in aqueous recovered solution (%) | Content of calcium citrate (%) | Remarks |
|---|---|---|---|---|---|---|---|
| 5th | 36.1 | 8.1 | 2.1 | 4.5 | 2.6 | 98.2 | Water 180%, demulsifier 0.003%, demetalizing aid 0.005% were supplemented |
| 10th | 38.5 | 9.6 | 1.8 | 3.7 | 3.5 | 98.3 | Water 450%, demulsifier 0.005%, demetalizing aid 0.015% were supplemented |
| 20th | 27.4 | 7.9 | 3.1 | 4.2 | 1.7 | 97.2 | Demetalizing composition 0.03% was supplemented |
| 30th | 31.9 | 8.2 | 1.9 | 5.9 | 1.2 | 96.8 | Demetalizing composition 0.4% was supplemented |
| 40th | 36.7 | 9.1 | 1.5 | 5.1 | 0.9 | 97.8 | Demetalizing composition 4.5% was supplemented |

It can be seen from Table 14 that, by supplementing the demetalizing composition for hydrogen oil or by supplementing water, the demulsifier and the demetalizing aid during the 40 recycles, the aqueous solution of the demetalizing composition for hydrocarbon oil did not have any effect on the demetalization of the dirty oil.

In Table 14, the demetalizing agents, interchangeable with each other, can be any one selected from the group consisting of formic acid, acetic acid, propionic acid, butyric acid, acetic anhydride, acetic propionic anhydride, succinic anhydride, benzenesulfonic acid, oxalic acid, citric acid, EDTA, organic phosphine carboxylic acid, organic phosphine sulfonic acid, and aminosulfonic acid, or a combination of two or more above-mentioned components. The demulsifiers, interchangeable with each other, can be any one selected from the group consisting of KR-40, LH-12, LH-14, PC-6, GAR-36, SH-1, SH-4, AY-910 available from Karamay Jinshan Petro-Chemical Limited Co., China, and other commercially available demulsifier suitable for demulsification of the hydrocarbon oil and other demulsifier known to the public suitable for demulsification of the hydrocarbon oil. The demetalizing aids, interchangeable with each other, can be any one selected from the group consisting of SP-80, SP-60, alkyl phenol polyoxyethylene ether (nonyl phenyl polyoxyethylene ether, octyl phenyl polyoxyethylene ether, and the like), styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components.

The percentage of demetalizing composition for hydrocarbon oils or aqueous solution thereof and the percentage of the other kinds of reagents supplemented and ingredients are all expressed by percentage by weight.

What is claimed is:

1. A recycling process for the demetalization of hydrocarbon oil comprising the following steps:

a demetalizing composition for hydrocarbon oil or an aqueous solution thereof is sufficiently mixed with hydrocarbon oil in a desired proportion, and the resultant mixture is subjected to a conventional electrically desalting process to obtain a demetalized hydrocarbon oil and an aqueous desalted solution containing the desalted metal salts;

the aqueous desalted solution containing the metal salts is then sufficiently mixed with a precipitating agent in a desired proportion and is subjected to a displacement reaction, and an aqueous solution containing the demetalizing composition is recovered by separating out the residue of the metal salts produced in the displacement reaction, which is poorly soluble or insoluble in water, by a solid-liquid separator; and the recovered aqueous solution containing the demetalizing composition for hydrocarbon oil, which meets the requirements for metal ions in demetalized hydrocarbon oil, is then mixed with hydrocarbon oil in a desired proportion for a next cycle.

2. The process as defined in claim 1, characterized in that:

the demetalizing composition for hydrocarbon oil comprises 10-99.5% by weight of a demetalizing agent, 0-90% by weight of a demulsifier, with the balance of a demetalizing aid; and the mixing proportion of the demetalizing composition for hydrocarbon oil. to the hydrocarbon oil is 0.002%-5% by weight based on the hydrocarbon oil.

3. The process as defined in claim 1, characterized in that:

the aqueous solution of demetalizing composition for hydrocarbon oil comprises 0.3-99.5% by weight of a demetalizing agent, 0-80% by weight of a demulsifier, 0-80% by weight of a demetalizing aid with the balance of water; and the mixing proportion of the aqueous solution of the demetalizing composition to the hydrocarbon oil is 0.002-99.5% by weight based on the hydrocarbon oil.

4. The process as defined in claim 2, characterized in that:

the demetalizing agent is any one selected from the group consisting of formic acid, acetic acid, propionic acid, butyric acid, acetic anhydride, acetic propionic anhydride, succinic anhydride, benzenesulfonic acid, citric acid, EDTA, organic phosphine carboxylic acid, organic phosphine sulfonic acid, and aminosulfonic acid, or a combination of two or more above-mentioned components, and the demetalizing agents can be interchangeable with each other; and/or, the demulsifier is any one selected from the group consisting of KR-40, LH-12, LH-14, PC-6, GAR-36, SH-1, SH-4, AY-910 and other commercially available demulsifier suitable for demulsification of the hydrocarbon oil and other demulsifier known to the public suitable for demulsification of the hydrocarbon oil and the demulsifiers can be interchangeable with each other; and/or, the demetalizing aids is any one selected from the group consisting of SP-80, SP-60, alkyl phenol polyoxyethylene ether, styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components and the demetalizing aids can be interchangeable with each other.

5. The process as defined in claim 1, characterized in that:

the aqueous desalted solution containing the metal salts is sufficiently mixed with the precipitating agent with a mixing proportion of from 1:1 to 10:1 by mole with respect to the metal salt contained in the aqueous desalted solution and the precipitating agent, at a temperature ranging from ambient temperature to 150 ° C.

6. The process as defined in claim 1, characterized in that:

the precipitating agent is selected from the group consisting of inorganic acids or organic acids which can react with the desired metal ions to be demetalized and produce precipitates poorly soluble or insoluble in water; or selected from the group consisting of sulfuric acid, phosphoric acid, hydrofluoric acid, sulfonic acid, and citric acid.

7. The process as defined in claim 1, characterized in that:

the residue of the separated metal salts is collected under the following conditions: firstly, the aqueous solution containing the metal salt residue is filtered at a temperature of from ambient temperature to 150°C. and at a pressure of from −1MPa to 1MPa to obtain the residue of the metal salts; then the metal salt residue is washed with water until the washed water has a pH value of 5-7 at a temperature of from ambient temperature to 100 ° C.; thereafter, the washed metal salt residue is either filtered and separated by gravitational settling or centrifugal settling, or filtered at a temperature of from ambient temperature to 100 ° C. and at a pressure of from −1MPa to 1MPa and dried at a temperature of 80 ° C. to 200 ° C. until the water content being less than 1% by weight, thereby obtaining the metal salts.

8. The process as defined in claim 3, characterized in that:

1%~500% of water, 0.001%~0.02% of the demulsifier, and 0.001%~0.02% of demetalizing aids, each based on the aqueous recovered solution containing the demetalizing composition for hydrocarbon oil, are supplemented, when the concentration of the above-mentioned demetalizing agents is higher than the prescribed proportion of the demetalizing agent to the hydrocarbon oil; or 0.001%~5% of the demetalizing agent, based on the aqueous recovered solution containing the demetalizing composition for hydrocarbon oil, is supplemented, when the concentration of the above-mentioned demetalizing agent is less than the proportion of the demetalizing agent to the hydrocarbon oil.

9. The process as defined in claim 1, characterized in that:

the conventional electrically desalting process is carried out under the following conditions: desalting temperature of 50 to 150 ° C., and strong electric field of 500 to 1500 V/cm with residence time of 5 to 200 minutes and/or weak electric field of 50to 500V/cm with residence time of 1 to 60 minutes; the hydrocarbon oil is sufficiently mixed with 2-20% water based on the amount of the hydrocarbon oil and the desired amount of the demetalizing composition for hydrocarbon oil or the aqueous solution thereof by means of a mixing valve or a static mixer at a temperature of 50 to 150 ° C. and a mixing pressure difference of 0.02MPa to 1.0MPa.

10. The process as defined in claim 1, characterized in that:

the mixing of the demetalizing composition for hydrocarbon oil or the aqueous solution thereof with the hydrocarbon oil is carried out by means of a emulsion shearing machine or a static mixer to control the diameters of oil-water particle in the range of 0.1μm to 50 μm.

11. The process as defined in claim 1, characterized in that:

the mixing of the demetalizing composition for hydrocarbon oil or the aqueous solution thereof with the hydrocarbon oil is carried out by means of film reactor having a film with the pore size of from 0.1 μm to 50 μm, and the film being selected from the group consisting of metal film, inorganic film and solvent resistance polyolefin film.

12. The process as defined in claim 3, characterized in that:

the demetalizing agent is any one selected from the group consisting of formic acid, acetic acid, propionic acid, butyric acid, acetic anhydride, acetic propionic anhydride, succinic anhydride, benzenesulfonic acid, citric acid, EDTA, organic phosphine carboxylie acid, organic phosphine sulfonic acid, and aminosulfonic acid, or a combination of two or more above-mentioned components, and the demetalizing agents can be interchangeable with each other; and/or, the demulsifier is any one selected from the group consisting of KR-40, LH-12, LH-14, PC-6, GAR-36, SH-1, SH-4, AY-910 and other commercially available demulsifier suitable for demulsification of the hydrocarbon oil and other demulsifier known to the public suitable for demulsification of the hydrocarbon oil and the demulsifiers can be interchangeable with each other; and/or, the demetalizing aids is any one selected from the group consisting of SP-80, SP-60, alkyl phenol polyoxyethylene ether, styrl polyoxyethylene ether, $C_8$-$C_{10}$ alkenyl phenol polyoxyethylene ether, $C_2$-$C_{18}$ fatty acid ester polyoxyethylene ether, and soluble potassium salt, sodium salt, and ammonium salt of sulfonate, or a combination of two or more above-mentioned components and the demetalizing aids can be interchangeable with each other.

13. The process as defined in claim 2, characterized in that:

the precipitating agent is selected from the group consisting of inorganic acids or organic acids which can react with the desired metal ions to be demetalized and produce precipitates poorly soluble or insoluble in water; or selected from the group consisting of sulfuric acid, phosphoric acid, hydrofluoric acid, sulfonic acid, and citric acid.

14. The process as defined in claim 3, characterized in that:

the precipitating agent is selected from the group consisting of inorganic acids or organic acids which can react with the desired metal ions to be demetalized and produce precipitates poorly soluble or insoluble in water; or selected from the group consisting of sulfuric acid, phosphoric acid, hydrofluoric acid, sulfonic acid, and citric acid.

15. The process as defined in claim 4, characterized in that:

the precipitating agent is selected from the group consisting of inorganic acids or organic acids which can react with the desired metal ions to be demetalized and produce precipitates poorly soluble or insoluble in water; or selected from the group consisting of sulfuric acid, phosphoric acid, hydrofluoric acid, sulfonice acid, and citric acid.

16. The process as defined in claim 5, characterized in that:

the precipitating agent is selected from the group consisting of inorganic acids or organic acids which can react with the desired metal ions to be demetalized and produce precipitates poorly soluble or insoluble in water; or selected from the group consisting of sulfuric acid, phosphoric acid, hydrofluoric acid, sulfonic acid, and citric acid.

17. The process as defined in claim 2, characterized in that:

the residue of the separated metal salts is collected under the following conditions: firstly, the aqueous solution containing the metal salt residue is filtered at a temperature of from ambient temperature to 150 ° C. and at a pressure of from −1MPa to 1MPa to obtain the residue of the metal salts; then the metal salt residue is washed with water until the washed water has a pH value of 5-7 at a temperature of from ambient temperature to 100 ° C.; thereafter, the washed metal salt residue is either filtered and separated by gravitational settling or centrifugal settling, or filtered at a temperature of from ambient temperature to 100 ° C. and at a pressure of from −1MPa to 1MPa and dried at a temperature of 80 ° C. to 200 ° C. until the water content being less than 1% by weight, thereby obtaining the metal salts.

18. The process as defined in claim 3, characterized in that:

the residue of the separated metal salts is collected under the following conditions: firstly, the aqueous solution containing the metal salt residue is filtered at a temperature of from ambient temperature to 150 ° C. and at a pressure of from −1MPa to 1MPa to obtain the residue of the metal salts; then the metal salt residue is washed with water until the washed water has a pH value of 5-7 at a temperature of from ambient temperature to 100 ° C.; thereafter, the washed metal salt residue is either filtered and separated by gravitational settling or centrifugal settling, or filtered at a temperature of from ambient temperature to 100 ° C. and at a pressure of from −1MPa to 1MPa and dried at a temperature of 80 ° C. to 200 ° C. until the water content being less than 1% by weight, thereby obtaining the metal salts.

19. The process as defined in claim 4, characterized in that:

the residue of the separated metal salts is collected under the following conditions: firstly, the aqueous solution containing the metal salt residue is filtered at a temperature of from ambient temperature to 150 ° C. and at a pressure of from −1MPa to 1MPa to obtain the residue of the metal salts; then the metal salt residue is washed with water until the washed water has a pH value of 5-7 at a temperature of from ambient temperature to 100 ° C.; thereafter, the washed metal salt residue is either filtered and separated by gravitational settling or centrifugal settling, or filtered at a temperature of from ambient temperature to 100 ° C. and at a pressure of from −1MPa to 1MPa and dried at a temperature of 80 ° C. to 200 ° C. until the water content being less than 1% by weight, thereby obtaining the metal salts.

* * * * *